United States Patent [19]

Albertson et al.

[11] 4,080,157

[45] Mar. 21, 1978

[54] WELDING TORCH LIGHTER

[76] Inventors: Quinton B. Albertson, 10049 1/2 Prospect, Santee, Calif. 92071; Andrew Danielson, 4578 Slade Rd., La Mesa, Calif. 92041

[21] Appl. No.: 696,417

[22] Filed: Jun. 14, 1976

[51] Int. Cl.[2] ..... A23C 0/00

[52] U.S. Cl. ..... 431/356; 24/81 B; 248/226.5; 248/316 D; 266/48; 403/398; 403/405

[58] Field of Search ..... 266/48; 110/1 F; 431/267, 356, 273, 343, 27, 276; 228/57, 902; 24/81 PE, 81 B, 85 A; 224/28, 265, 37, 38; 403/405, 406, 282, 278, 398, 391, 188; 248/74 A, 226.5, 316 D; 339/223, 276 A, 276 R, 276 C, 276 D, 276 E, 276 F, 276 S, 276 SF, 276 T

[56] References Cited

U.S. PATENT DOCUMENTS

| | | | |
|---|---|---|---|
| 2,523,465 | 9/1950 | Graham | 403/282 |
| 2,592,951 | 4/1952 | Randall | 431/273 |
| 3,052,112 | 9/1962 | Wheeler | 431/276 |
| 3,123,431 | 3/1964 | Keller | 339/276 |
| 3,156,764 | 11/1964 | Toedtman | 403/391 |
| 3,194,877 | 7/1965 | Collier | 339/276 |
| 3,197,729 | 7/1965 | Sarazen | 339/223 |
| 3,546,663 | 12/1968 | Holmberg | 339/223 |
| 3,767,841 | 10/1973 | Anderson et al. | 339/276 R |

*Primary Examiner*—Edward G. Favors
*Assistant Examiner*—R. J. Charvat
*Attorney, Agent, or Firm*—Ralph S. Branscomb

[57] ABSTRACT

The invention is a mounting bracket for mounting a flint striker used to ignite an oxyacetylene torch, the bracket connecting the striker to the gas feed hoses of the torch so that the welder knows at all times where the striker can be found.

2 Claims, 4 Drawing Figures

WELDING TORCH LIGHTER

BACKGROUND OF THE INVENTION

The invention relates to welding accessories and particularly to welding apparatus using a gas flame requiring the periodic ignition of the torch.

Virtually all welders use a device called a "striker" comprising a pair of resilient arms joined at one end and having a flint and striker element at the other ends to ignite the gases, which are usually oxygen and acetylene or propone. Over a period of time of course the torch must be extinguished and reignited as various pieces are welded and verious welding jobs are undertaken, and it is natural that the welder often misplaces the striker and spends a few seconds searching for the striker each time the torch must be ignited so that he may continue work. Although it would not seem as though a great deal of time lapses during this search under ordinary circumstances, the accumulative loss can be quite great and the aggravation and annoyance caused the welder only adds to other frustrations inherent in the job. There is a need for a way to localize the striker in a single place which may be relied upon consistently by the welder but which at the same time permits the striker to be moved easily into the vicinity of the torch.

SUMMARY OF THE INVENTION

The present invention solves the above-mentioned problem and provides a bracket having two end portions, one of which defines a plurality of tabs which are bent around the connected spring arms of a striker to securely engage the striker, and the other end portion is coated with a rubbery non-scratch material and is bent in a direction opposite the tabs to engage the welding hoses. The unit may be sold by itself or attached to a welding striker and is ordinarily attached to the hose such that the striker points in the direction opposite the torch. The location of the striker is thus always known to the welder when it is so attached.

DETAILED DESCRIPTION OF THE PREFERRED EMBODIMENT

Figure 1:
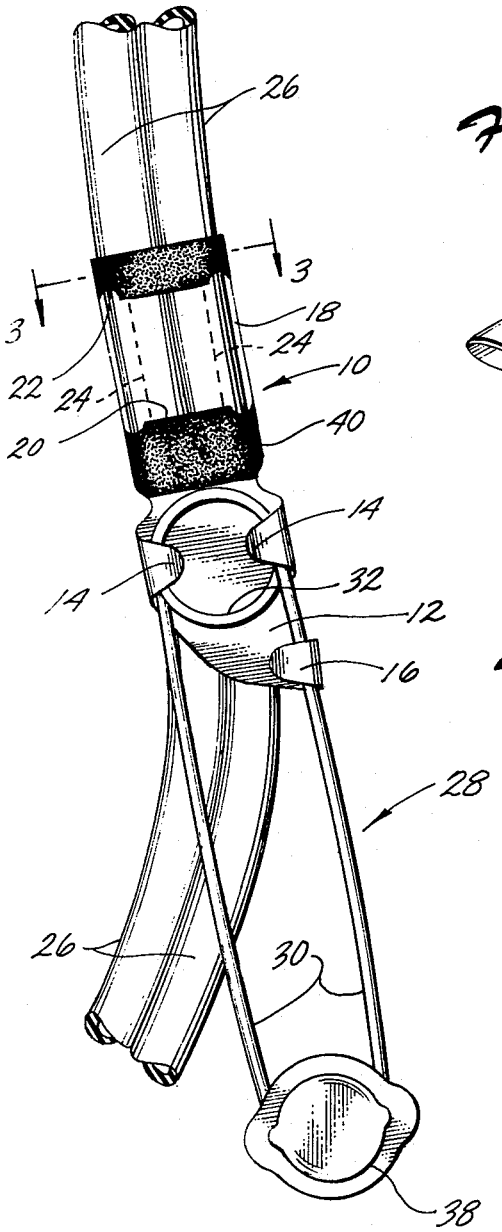
FIG. 1 is a top elevation view showing a fragment of the hose pair having the bracket and striker attached thereto.

The invention in its unattached state is best seen in FIG. 1, where it can be easily imagined that in the preferred mode of construction of the unit it is stamped from a single sheet of flat metal. Subsequent to the initial stamping the resultant plate is bent by other stamping processes or simply by hand into a clamping bracket 10 having a first portion 12 which is stamped such that two opposite tabs 14 are bent in confronting relation, and a third tab 16 spaced from one of the first tabs is provided, the area of the bracket between these tabs being flat.

The bracket has a second portion 18 which was clearly substantially rectangular as stamped, although preferably the corners would be rounded as shown. This rectangular second portion also has a stamped out, substantially rectangular cutaway portion 20 occupying the major area of the center of the second portion of the bracket and having lobes 22 at the corners of the cut-away portion, or at both ends of the side edges of the removed area. The outer edges of the second portion, and the outer edges of the cut-away portion define flanges 24 which as can be seen in the drawings are arcuately curved laterally to the form particularly well illustrated in FIG. 2. At this stage, during the manufacture of the unit, it is preferred that the second portion 18 of the bracket be dipped in a rubberlike nonabrasive compound which will harden into solid form to portect the welding hoses 26.

Figure 4:
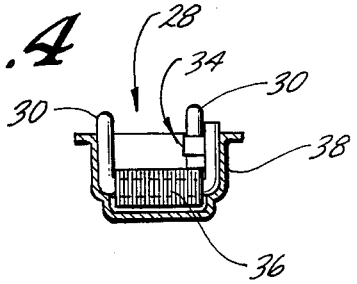
FIG. 4 is a sectional view taken laterally through the striker showing the flint arrangement.

The striker which is to be attached by means of the bracket to the welding hoses is shown at 28 and has a pair of resilient spring arms 30 which are joined by means of a unitary loop 32 at one end, this loop acting as a spring such that the other ends are biased apart. As shown in FIG. 4 a flint 34 is mounted on the other end of one of the spring arms and the other spring arm is provided with a striking element 36 disposed in a cup 38 in a conventional striker such that when the two spring arms are squeezed together the flint is moved relative to the striker to make a large spark. In another variation of the striker, a metallic band is used instead of the heavy wire shown to form the spring arms, but otherwise the striker is very similar to that illustrated.

Figure 3:
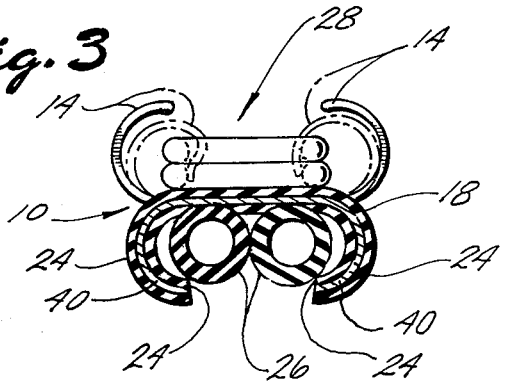
FIG. 3 is a sectional view taken along lines 3—3 of FIG. 1.

The loop 32 of the striker is engaged in the tabs 14, which are subsequently crimped around the loop as is shown in phantom in FIG. 3 to securely engage the joined ends of the striker, and the third tab 16 is bent around one arm only so that the necessary movement to effect a striking action is still possible although the striker is securely gripped by the attachment. The other end portion of the bracket is secured around the hoses as is shown in FIG. 3 and the flanges crimped inwardly to snuggly embrace the hoses and prevent dislodgement of the unit. The rubber coating, which is indicated at 40, will prevent the gouging or marring of the hoses.

The cut-away portion 20 of the mounting bracket not only saves a certain amount of metal but permits the easy bending of the flanges, and the lobes 22 of the cut-away portion define the areas of the metal which will be bent as the flanges are crimped around the hoses.

Figure 2:
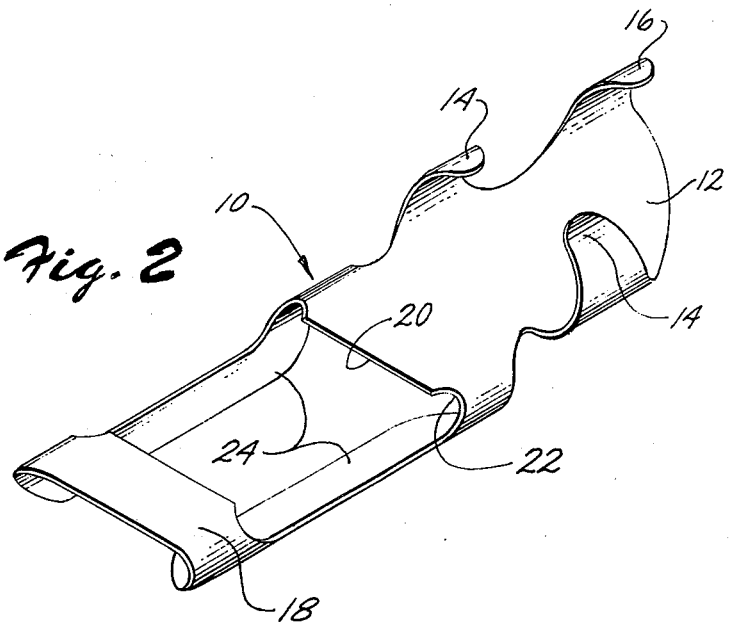
FIG. 2 is a perspective view of the invention in its unattached but preformed state.

Thus the unit, when sold in the form illustrated in FIG. 2, can be easily attached to a striker, which is crimped securely and permanently into place in the bracket, and the entire unit is then securely engaged on the hoses as shown. If it is necessary to remove the striker for any reason, this can of course be done by using a screwdriver or other hand tool to bend the flanges apart to effect the removal. The bracket is clearly adapted to economical manufacture and thus an acceptable retail price, and would be a must in any welding shop in which acetylene equipment is used.

I claim:

1. A connector for attaching a welding striker to welding hoses comprising:

(a) an elongated bracket having a first end portion having a plurality of arcuate tabs dimensioned to receive and be crimped around two side arms of a flint striker;

(b) said bracket having a second end portion having a pair of arcuate flanges bent to define an open channel direct - in the opposite direction relative to the longitudinal axis of said bracket from said arcuate tabs, said channel being dimensioned to receive and embrace in substantial longitudinal alignment with said bracket a pair of welding hoses; and (c) said second portion being formed as a substantially rectangular plate having a rectangular cut-away portion therein, said cut-away portion defining the inner edges of said flanges and facilitating the bending of same to tightly embrace a pair of welding hoses.

2. Structure according to claim 1 wherein said cut-away portion includes two pairs of lobes defined at the ends of the inner edges of said flanges to define bending areas of the second portion of said bracket.

* * * * *